US012065809B2

(12) United States Patent
Izuka et al.

(10) Patent No.: US 12,065,809 B2
(45) Date of Patent: Aug. 20, 2024

(54) DAMAGE ESTIMATION DEVICE AND MACHINE LEARNING DEVICE

(71) Applicant: KOBELCO CONSTRUCTION MACHINERY CO., LTD., Hiroshima (JP)

(72) Inventors: Takaaki Izuka, Hiroshima (JP); Koji Sumimoto, Hiroshima (JP); Katsuya Irieda, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 281 days.

(21) Appl. No.: 17/422,317

(22) PCT Filed: Jan. 16, 2020

(86) PCT No.: PCT/JP2020/001365
§ 371 (c)(1),
(2) Date: Jul. 12, 2021

(87) PCT Pub. No.: WO2020/162136
PCT Pub. Date: Aug. 13, 2020

(65) Prior Publication Data

US 2022/0090363 A1 Mar. 24, 2022

(30) Foreign Application Priority Data

Feb. 8, 2019 (JP) ..... 2019-021832

(51) Int. Cl.
*E02F 9/26* (2006.01)
*E02F 3/90* (2006.01)
*E02F 3/92* (2006.01)

(52) U.S. Cl.
CPC ..... *E02F 9/267* (2013.01); *E02F 3/907* (2013.01); *E02F 3/92* (2013.01)

(58) Field of Classification Search
CPC ... E02F 9/267; E02F 3/907; E02F 3/92; E02F 3/435
(Continued)

(56) References Cited

U.S. PATENT DOCUMENTS 9,783,952 B2 * 10/2017 Nagato ..... G07C 5/0816
10,294,636 B2 * 5/2019 Leslie ..... E02F 9/24
(Continued)

FOREIGN PATENT DOCUMENTS

JP 2-165285 A 6/1990
JP 2005-25351 A 1/2005
(Continued)

OTHER PUBLICATIONS

Combined Chinese Office Action and Search Report issued on Apr. 15, 2022 in Chinese Patent Application No. 202080012503.4 (with English translation), 12 pages.
(Continued)

*Primary Examiner* — Hunter B Lonsberry
*Assistant Examiner* — Robert Louis Pinkerton
(74) *Attorney, Agent, or Firm* — Oblon, McClelland, Maier & Neustadt, L.L.P.

(57) ABSTRACT

A damage estimation device includes: an operation parameter reception unit that acquires an operation parameter related to an operation of a work machine; a damage estimation model storage unit that stores a damage estimation model constructed by machine learning using training data with the operation parameter as an input value and a damage parameter related to damage in a predetermined portion of the work machine as an output value; and a damage parameter estimation unit that estimates the damage parameter by inputting the operation parameter acquired by
(Continued)

the operation parameter reception unit to the damage estimation model stored in the damage estimation model storage unit.

8 Claims, 10 Drawing Sheets

(58) Field of Classification Search
USPC ..... 701/29.1
See application file for complete search history.

(56) References Cited

U.S. PATENT DOCUMENTS

| | | | | |
|---|---|---|---|---|
| 11,427,984 | B2 * | 8/2022 | Roh | E02F 9/264 |
| 2006/0142990 | A1 | 6/2006 | Vatchkov et al. | |
| 2007/0244841 | A1 * | 10/2007 | Vatchkov | G06N 3/045 706/16 |
| 2010/0070130 | A1 | 3/2010 | Suzuki et al. | |
| 2014/0195184 | A1 * | 7/2014 | Maeda | G05B 21/02 702/183 |
| 2015/0346066 | A1 * | 12/2015 | Dutta | G01M 99/008 702/183 |
| 2017/0089044 | A1 * | 3/2017 | Chitty | G01M 5/0033 |
| 2020/0407945 | A1 * | 12/2020 | Okada | E02F 9/267 |
| 2021/0002871 | A1 * | 1/2021 | Yamanaka | E02F 3/32 |
| 2021/0230828 | A1 * | 7/2021 | Shintani | E02F 3/435 |
| 2022/0066408 | A1 * | 3/2022 | Allison | G05B 19/0428 |
| 2022/0097621 | A1 * | 3/2022 | Nakamura | E02F 9/264 |
| 2022/0178115 | A1 * | 6/2022 | Ogasawara | E02F 9/267 |
| 2022/0254054 | A1 * | 8/2022 | Okada | E02F 9/267 |
| 2022/0259823 | A1 * | 8/2022 | Yoshida | E02F 9/2045 |
| 2022/0396933 | A1 * | 12/2022 | Ogasawara | E02F 9/264 |
| 2023/0122177 | A1 * | 4/2023 | Ueta | E02F 3/32 701/50 |

FOREIGN PATENT DOCUMENTS

| | | | | |
|---|---|---|---|---|
| JP | 2007-257366 | A | 10/2007 | |
| JP | 2009-133194 | A | 6/2009 | |
| JP | 2013-41448 | A | 2/2013 | |
| JP | 2014-85293 | A | 5/2014 | |
| JP | 2017-166232 | A | 9/2017 | |
| JP | 2019-5834 | A | 1/2019 | |
| WO | WO 2009/020229 | A1 | 2/2009 | |
| WO | WO-2013040633 | A1 * | 3/2013 | E02F 9/2054 |
| WO | WO 2013/172277 | A1 | 11/2013 | |
| WO | WO 2016/101003 | A1 | 6/2016 | |
| WO | WO-2016101003 | A1 * | 6/2016 | E02F 9/226 |

OTHER PUBLICATIONS

International Search Report issued on Mar. 17, 2020 in PCT/JP2020/001365 filed on Jan. 16, 2020, 3 pages.
Extended European Search Report issued Feb. 2, 2022 in European Patent Application No. 20751919.0, 9 pages.

* cited by examiner

FIG. 5

232

DAMAGE ESTIMATION MODEL STORAGE UNIT

| FIRST DAMAGE ESTIMATION MODEL | |
|---|---|
| BOOM | 6m |
| ARM | 3m |
| BUCKET | $1m^3$ |

| SECOND DAMAGE ESTIMATION MODEL | |
|---|---|
| BOOM | 6m |
| ARM | 2m |
| BUCKET | $1m^3$ |

| THIRD DAMAGE ESTIMATION MODEL | |
|---|---|
| BOOM | 6m |
| ARM | 4m |
| BUCKET | $1m^3$ |

| FOURTH DAMAGE ESTIMATION MODEL | |
|---|---|
| BOOM | 6m |
| ARM | 3m |
| BUCKET | $1.2m^3$ |

| FIFTH DAMAGE ESTIMATION MODEL | |
|---|---|
| BOOM | 6m |
| ARM | 2m |
| BUCKET | $1.5m^3$ |

| SIXTH DAMAGE ESTIMATION MODEL | |
|---|---|
| BOOM | 6m |
| ARM | 4m |
| BUCKET | $0.8m^3$ |

DAMAGE ESTIMATION DEVICE AND MACHINE LEARNING DEVICE

TECHNICAL FIELD

The present disclosure relates to a damage estimation device that estimates damage in a predetermined portion associated with an operation of a work machine, and a machine learning device that performs machine learning on a damage estimation model for estimating damage in a predetermined portion associated with the operation of a work machine.

BACKGROUND ART

A manager who manages a work machine such as a hydraulic excavator can create a maintenance plan of the work machine and review the work by knowing the lifespan of the work machine.

Conventional techniques for predicting the lifespan of a work machine include a technique in which a plurality of strain gauges are attached to a boom and an arm of the work machine, a mechanical strain amount due to a load applied to the boom and the arm is detected by the plurality of strain gauges, a damage amount of each portion of the work machine is calculated based on the detected strain amount, and thus the lifespan is predicted (see Patent Literature 1, for example).

In the technique of Patent Literature 1, a plurality of strain gauges are attached to a boom and an arm, and a strain amount is detected by the plurality of strain gauges. At this time, the plurality of strain gauges are directly affixed to the surfaces of the portions of the boom and the arm to be measured, and conductor wires extending from the plurality of strain gauges are drawn into the measurement instrument.

However, it is a very troublesome work to affix the plurality of strain gauges to the surfaces of portions to be measured. The strain gauge may be damaged during work at the work site, and it is difficult to estimate the accurate lifespan from the damaged strain gauge.

CITATION LIST

Patent Literature

Patent Literature 1: JP 2009-133194 A

Summary of Invention

The present disclosure has been made to solve the above-mentioned problems, and an object of the present disclosure is to provide a damage estimation device and a machine learning device capable of accurately and easily estimating the lifespan of a work machine.

A damage estimation device according to one aspect of the present disclosure is a damage estimation device that estimates damage in a predetermined portion associated with an operation of a work machine, the damage estimation device including: an operation parameter acquisition unit that acquires an operation parameter related to the operation of the work machine; a damage estimation model storage unit that stores a damage estimation model constructed by machine learning using training data with the operation parameter as an input value and a damage parameter related to damage in the predetermined portion of the work machine as an output value; and an estimation unit that estimates the damage parameter by inputting the operation parameter acquired by the operation parameter acquisition unit to the damage estimation model stored in the damage estimation model storage unit.

According to the present disclosure, it is possible to estimate a damage parameter related to damage in a predetermined portion associated with an operation of a work machine, and to accurately and easily estimate the lifespan of the work machine from the estimated damage parameter.

BRIEF DESCRIPTION OF DRAWINGS

FIG. 5 is a view showing an example of a plurality of damage estimation models stored in a damage estimation model storage unit in the first embodiment.

DESCRIPTION OF EMBODIMENTS

Embodiments of the present disclosure will be described below with reference to the accompanying drawings. The following embodiments are examples of embodiments of the present disclosure, and are not intended to limit the technical scope of the present disclosure.

First Embodiment

Figure 1:
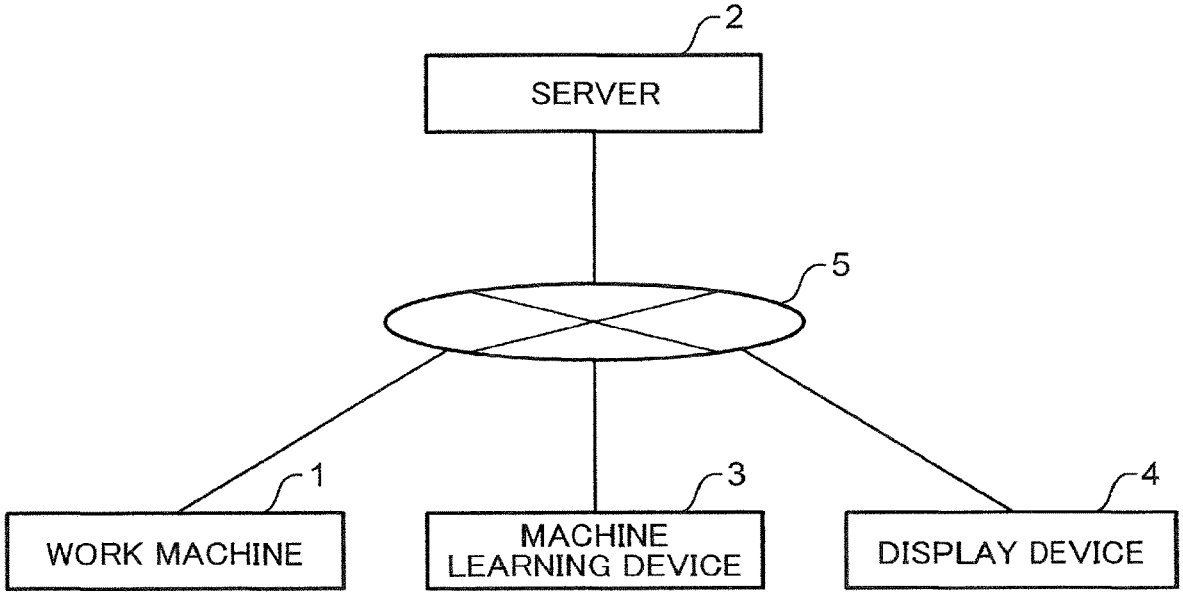
FIG. 1 is a view showing an overall configuration of a damage estimation system according to a first embodiment of the present disclosure.

FIG. 1 is a view showing an overall configuration of the damage estimation system according to the first embodiment of the present disclosure.

The damage estimation system shown in FIG. 1 includes a work machine 1, a server 2, a machine learning device 3, and a display device 4. The server 2 is communicatively connected to each of the work machine 1, the machine learning device 3, and the display device 4 via a network 5. The network 5 is, for example, the Internet.

Figure 2:
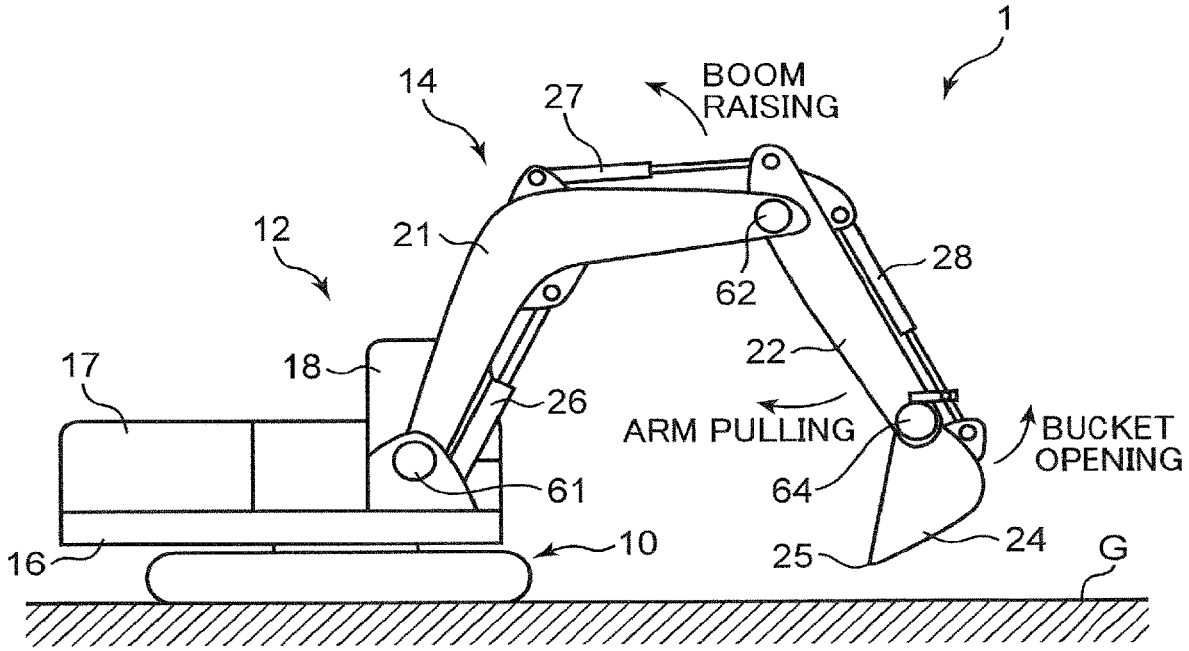
FIG. 2 is a view showing a work machine according to the first embodiment of the present disclosure.

FIG. 2 is a view showing the work machine according to the first embodiment of the present disclosure.

The work machine 1 shown in FIG. 2 is, for example, a hydraulic excavator. The work machine 1 includes a lower travelling body 10 that can travel on a ground G, an upper slewing body 12 mounted on the lower travelling body 10, and a work device 14 mounted on the upper slewing body 12. In the first embodiment, a hydraulic excavator is presented as an example of the work machine 1. However, the present disclosure is not limited thereto, and any work machine may be adopted as the work machine 1 as long as the work machine includes a lower travelling body, an upper stewing body, and a work device such as a hydraulic crane.

The lower travelling body 10 and the upper slewing body 12 constitute a machine body that supports the work device 14. The upper slewing body 12 has a stewing frame 16 and a plurality of elements mounted on the slewing frame 16. The plurality of elements include an engine room 17 housing an engine and a cab 18 that is a driver's compartment. The lower travelling body 10 is formed of a pair of crawlers. The upper slewing body 12 is slewably attached to the lower travelling body 10.

The work device 14 is capable of performing operations for excavation work and other necessary works, and includes a boom 21, an arm 22, and a bucket 24. The boom 21 has a base end supported at the front end of the slewing frame 16 in a raising and lowering manner, i.e., in a swingable manner about a horizontal axis, and a tip end on the opposite side of the base end. The arm 22 has a base end swingably attached to the tip end of the boom 21 about a horizontal axis, and a tip end on the opposite side of the base end. The bucket 24 is swingably attached to the tip end of the arm 22.

A boom cylinder 26, an arm cylinder 27, and a bucket cylinder 28, which are a plurality of extendable hydraulic cylinders, are attached to the boom 21, the arm 22, and the bucket 24, respectively.

The boom cylinder 26 is interposed between the upper slewing body 12 and the boom 21, and is extended and contracted so as to cause the boom 21 to perform a raising and lowering operation. Specifically, the boom cylinder 26 has a head side chamber and a rod side chamber. When hydraulic oil is supplied to the head side chamber, the boom cylinder 26 is extended to move the boom 21 in a boom raising direction and discharge the hydraulic oil in the rod side chamber. On the other hand, when hydraulic oil is supplied to the rod side chamber, the boom cylinder 26 is contracted to move the boom 21 in a boom lowering direction and discharge the hydraulic oil in the head side chamber.

The arm cylinder 27 is interposed between the boom 21 and the arm 22, and is extended and contracted so as to cause the arm 22 to perform a swinging operation. Specifically, the arm cylinder 27 has a head side chamber and a rod side chamber. When hydraulic oil is supplied to the head side chamber, the arm cylinder 27 is extended to move the arm 22 in an arm pulling direction (direction in which the tip of the arm 22 approaches the boom 21) and discharge the hydraulic oil in the rod side chamber. On the other hand, when hydraulic oil is supplied to the rod side chamber, the arm cylinder 27 is contracted to move the arm 22 in an arm pushing direction (direction in which the tip of the arm 22 separates from the boom 21) and discharge the hydraulic oil in the head side chamber.

The bucket cylinder 28 is interposed between the arm 22 and the bucket 24, and is extended and contracted so as to cause the bucket 24 to perform a swinging operation. Specifically, the bucket cylinder 28 has a head side chamber and a rod side chamber. When hydraulic oil is supplied to the head side chamber, the bucket cylinder 28 is extended to swing the bucket 24 in a scooping direction (direction in which a tip 25 of the bucket 24 approaches the arm 22) and discharge the hydraulic oil in the rod side chamber. On the other hand, when hydraulic oil is supplied to the rod side chamber, the bucket cylinder 28 is contracted to swing the bucket 24 in an opening direction (direction in which the tip 25 of the bucket 24 is separated from the arm 22) and discharge the hydraulic oil in the head side chamber.

Figure 3:
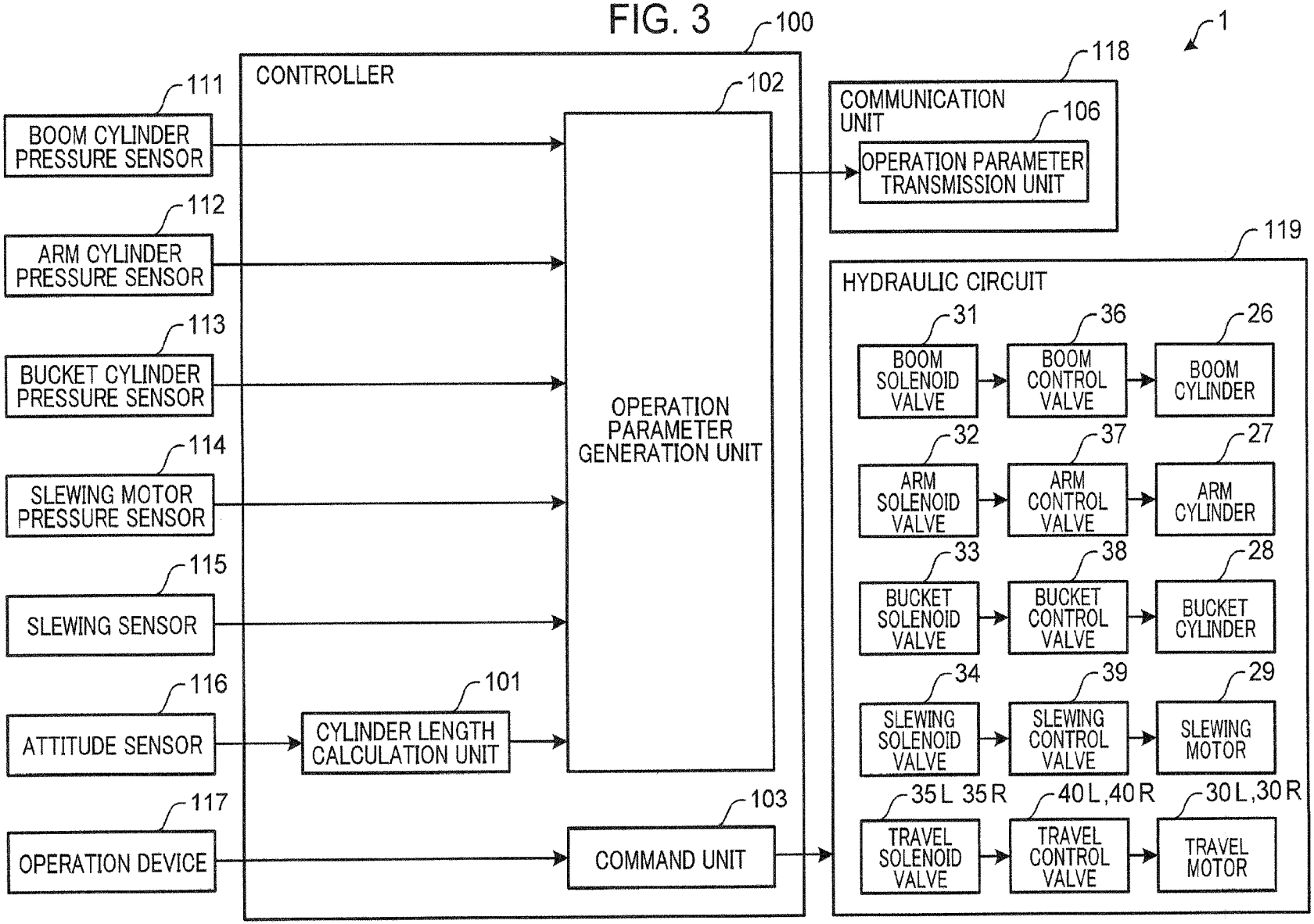
FIG. 3 is a block diagram showing a configuration of the work machine shown in FIG. 2.

FIG. 3 is a block diagram showing the configuration of the work machine shown in FIG. 2. The work machine 1 includes a controller 100, a boom cylinder pressure sensor 111, an arm cylinder pressure sensor 112, a bucket cylinder pressure sensor 113, a slewing motor pressure sensor 114, a slewing sensor 115, an attitude sensor 116, an operation device 117, a communication unit 118, and a hydraulic circuit 119.

The hydraulic circuit 119 includes, in addition to the boom cylinder 26, the arm cylinder 27, and the bucket cylinder 28, which are shown in FIG. 2, a slewing motor 29, a pair of left and right travel motors 30L and 30R, a pair of boom solenoid valves 31, a pair of arm solenoid valves 32, a pair of bucket solenoid valves 33, a pair of slewing solenoid valves 34, a pair of left travel solenoid valves 35L, a pair of right travel solenoid valves 35R, a boom control valve 36, an arm control valve 37, a bucket control valve 38, a slewing control valve 39, and a pair of left and right travel control valves 40L and 40R.

The slewing motor 29 has a motor output shaft that rotates in both directions by receiving supply of hydraulic oil from a hydraulic pump, and causes the upper slewing body 12 coupled to the motor output shaft to perform left slewing operation or right slewing operation. The slewing motor 29 is a hydraulic motor that operates so as to slew the upper slewing body 12 with respect to the lower travelling body 10 by receiving supply of hydraulic oil from the hydraulic pump. Specifically, the slewing motor 29 has an output shaft coupled to the upper slewing body 12, and a motor body that rotates the output shaft by receiving supply of hydraulic oil. The slewing motor 29 has a right slewing port and a left slewing port. By receiving supply of hydraulic oil to the right slewing port, the slewing motor 29 discharges the hydraulic oil from the left slewing port while slewing the upper slewing body 12 to the right direction. On the other hand, by receiving supply of hydraulic oil to the left slewing port, the slewing motor 29 discharges the hydraulic oil from the right slewing port while slewing the upper slewing body 12 to the left direction. The slewing motor 29 slews the upper slewing body 12 at a speed corresponding to the flow rate of the hydraulic oil flowing through the slewing motor 29.

The travel motor 30L and the travel motor 30R each have a motor output shaft that rotates in both directions by receiving supply of hydraulic oil from the hydraulic pump, and causes the lower travelling body 10 coupled to the motor output shaft to perform forward travelling operation or backward travelling operation. When the travel motor 30L and the travel motor 30R rotate at the same speed, the lower travelling body 10 moves forward or backward. On the other hand, when the travel motor 30L and the travel motor 30R rotate at different speeds, the lower travelling body 10 slews.

The boom control valve 36 includes a hydraulic pilot selector valve having a pair of boom pilot ports, and, by inputting boom pilot pressure to any of the pair of boom pilot ports, is opened at a stroke corresponding to the magnitude of the boom pilot pressure in a direction corresponding to the boom pilot port, thereby changing the direction and flow rate of the supply of the hydraulic oil to the boom cylinder 26.

The arm control valve 37 includes a hydraulic pilot selector valve having a pair of arm pilot ports, and, by inputting arm pilot pressure to any of the pair of arm pilot ports, is opened at a stroke corresponding to the magnitude of the arm pilot pressure in a direction corresponding to the arm pilot port, thereby changing the direction and flow rate of the supply of the hydraulic oil to the arm cylinder 27.

The bucket control valve 38 includes a hydraulic pilot selector valve having a pair of bucket pilot ports, and, by inputting bucket pilot pressure to any of the pair of bucket pilot ports, is opened at a stroke corresponding to the magnitude of the bucket pilot pressure in a direction corresponding to the bucket pilot port, thereby changing the direction and flow rate of the supply of the hydraulic oil to the bucket cylinder 28.

The slewing control valve 39 includes a hydraulic pilot selector valve having a pair of slewing pilot ports, and, by inputting stewing pilot pressure to any of the pair of slewing pilot ports, is opened at a stroke corresponding to the magnitude of the slewing pilot pressure in a direction corresponding to the slewing pilot port, thereby changing the direction and flow rate of the supply of the hydraulic oil to the slewing motor 29.

The travel control valves 40L and 40R each include a hydraulic pilot selector valve having a pair of travel pilot ports, and, by inputting travel pilot pressure to any of the pair of travel pilot ports, are opened at a stroke corresponding to the magnitude of the travel pilot pressure in a direction corresponding to the travel pilot port, thereby changing the direction and flow rate of the supply of the hydraulic oil to the travel motors 30L and 30R.

The pair of boom solenoid valves 31 are solenoid valves each interposed between the pilot pump and the pair of boom pilot ports of the boom control valve 36, and perform opening and closing operations upon receiving input of a boom command signal that is an electric signal. Upon receiving input of a boom command signal, the pair of boom solenoid valves 31 adjust the boom pilot pressure to the degree corresponding to the boom command signal.

The pair of arm solenoid valves 32 are solenoid valves each interposed between the pilot pump and the pair of arm pilot ports of the arm control valve 37, and perform opening and closing operations upon receiving input of an arm command signal that is an electric signal. Upon receiving input of an arm command signal, the pair of aim solenoid valves 32 adjust the arm pilot pressure to the degree corresponding to the arm command signal.

The pair of bucket solenoid valves 33 are solenoid valves each interposed between the pilot pump and the pair of arm pilot ports of the bucket control valve 38, and perform opening and closing operations upon receiving input of a bucket command signal that is an electric signal. Upon receiving input of a bucket command signal, the pair of bucket solenoid valves 33 adjust the bucket pilot pressure to the degree corresponding to the bucket command signal.

The pair of slewing solenoid valves 34 are solenoid valves each interposed between the pilot pump and the pair of slewing pilot ports of the slewing control valve 39, and perform opening and closing operations upon receiving input of a slewing command signal that is an electric signal. Upon receiving input of a slewing command signal, the slewing solenoid valve 34 adjusts the slewing pilot pressure to the degree corresponding to the slewing command signal.

The pair of travel solenoid valves 35L are solenoid valves each interposed between the pilot pump and the pair of travel pilot ports of the travel control valve 40L, and perform opening and closing operations upon receiving input of a slewing command signal that is an electric signal. Upon receiving input of a travel command signal, the pair of travel solenoid valves 35L adjust the travel pilot pressure to the degree corresponding to the travel command signal.

The pair of travel solenoid valves 35R are solenoid valves each interposed between the pilot pump and the pair of travel pilot ports of the travel control valve 40R, and perform opening and closing operations upon receiving input of a slewing command signal that is an electric signal. Upon receiving input of a travel command signal, the travel solenoid valve 35R adjusts the travel pilot pressure to the degree corresponding to the travel command signal.

The boom cylinder pressure sensor 111 detects a pressure value of the boom cylinder 26. Specifically, the boom cylinder pressure sensor 111 includes a boom cylinder head pressure sensor and a boom cylinder rod pressure sensor. The boom cylinder head pressure sensor detects the boom cylinder head pressure, which is the pressure of hydraulic oil in the head side chamber of the boom cylinder 26. The boom cylinder rod pressure sensor detects the boom cylinder rod pressure, which is the pressure of hydraulic oil in the rod side chamber of the boom cylinder 26. The boom cylinder pressure sensor 111 converts the detected boom cylinder head pressure and boom cylinder rod pressure into detection signals that are electric signals corresponding to these, and inputs the detection signals to the controller 100.

The arm cylinder pressure sensor 112 detects a pressure value of the arm cylinder 27. Specifically, the arm cylinder pressure sensor 112 includes an arm cylinder head pressure sensor and an arm cylinder rod pressure sensor. The arm cylinder head pressure sensor detects the arm cylinder head pressure, which is the pressure of hydraulic oil in the head side chamber of the arm cylinder 27. The arm cylinder rod pressure sensor detects the arm cylinder rod pressure, which is the pressure of hydraulic oil in the rod side chamber of the arm cylinder 27. The arm cylinder pressure sensor 112 converts the detected arm cylinder head pressure and arm cylinder rod pressure into detection signals that are electric signals corresponding to these, and inputs the detection signals to the controller 100.

The bucket cylinder pressure sensor 113 detects a pressure value of the bucket cylinder 28. Specifically, the bucket cylinder pressure sensor 113 includes a bucket cylinder head pressure sensor and a bucket cylinder rod pressure sensor. The bucket cylinder head pressure sensor detects the bucket cylinder head pressure, which is the pressure of hydraulic oil in the head side chamber of the bucket cylinder 28. The bucket cylinder rod pressure sensor detects the bucket cylinder rod pressure, which is the pressure of hydraulic oil in the rod side chamber of the bucket cylinder 28. The bucket cylinder pressure sensor 113 converts the detected bucket cylinder head pressure and bucket cylinder rod pressure into detection signals that are electric signals corresponding to these, and inputs the detection signals to the controller 100.

The slewing motor pressure sensor 114 detects the operation pressure value of the slewing motor 29, i.e., the motor differential pressure. Specifically, the slewing motor pressure sensor 114 includes a right slewing port pressure sensor and a left slewing port pressure sensor. The right slewing port pressure sensor detects right slewing port pressure, which is the pressure of hydraulic oil in the right slewing port of the slewing motor 29. The left slewing port pressure sensor detects left slewing port pressure, which is the pressure of hydraulic oil in the left slewing port of the slewing motor 29. The slewing motor pressure sensor 114 converts the differential pressure between the detected right slewing port pressure and left slewing port pressure into a detection signal that is an electric signal corresponding to this, and inputs the detection signal to the controller 100.

The slewing motor pressure sensor 114 may convert the detected right slewing port pressure into a detection signal that is an electric signal corresponding to this, and input the detection signal to the controller 100, or may convert the detected left slewing port pressure into a detection signal that is an electric signal corresponding to this, and input the detection signal to the controller 100.

The slewing sensor 115 is configured by, for example, a resolver or a rotary encoder, and detects the slewing angle of the upper stewing body 12 with respect to the lower travelling body 10. The slewing sensor 115 converts the detected slewing angle into a detection signal that is an electric signal corresponding to this, and inputs the detection signal to the controller 100.

The attitude sensor 116 detects the attitude of the work device 14. The attitude sensor 116 includes a boom angle sensor 61, an arm angle sensor 62, and a bucket angle sensor 64, which are shown in FIG. 2. The boom angle sensor 61 detects a boom angle, which is the rotation angle of the boom 21 with respect to the upper slewing body 12. The arm angle sensor 62 detects an arm angle, which is the rotation angle of the arm 22 with respect to the boom 21. The bucket angle sensor 64 detects a bucket angle, which is the rotation angle of the bucket 24 with respect to the arm 22. The boom angle sensor 61, the arm angle sensor 62, and the bucket angle sensor 64 are each configured by a resolver or a rotary encoder. The attitude sensor 116 converts the detected boom angle, arm angle, and bucket angle into detection signals that are electric signals corresponding to these, and inputs the detection signals to the controller 100.

The operation device 117 receives an operation from an operator for the operation of the work device 14, the slewing operation of the upper slewing body 12, and the travelling operation of the lower travelling body 10. The operation device 117 includes a boom operation device, an arm operation device, a bucket operation device, a slewing operation device, and a travel operation device.

The boom operation device is configured by an electric lever device including a boom operation lever for receiving an operation from the operator for a boom raising operation or a boom lowering operation, and an operation signal generation unit that inputs an operation amount of the boom operation lever to the controller 100.

The arm operation device is configured by an electric lever device including an arm operation lever for receiving an operation from the operator for an arm pulling operation or an arm pushing operation, and an operation signal generation unit that inputs an operation amount of the aim operation lever to the controller 100.

The bucket operation device is configured by an electric lever device including a bucket operation lever for receiving an operation from the operator for a bucket scooping operation or a bucket opening operation, and an operation signal generation unit that inputs an operation amount of the bucket operation lever to the controller 100.

The slewing operation device is configured by an electric lever device including a slewing operation lever for receiving an operation from the operator for slewing the upper slewing body 12 to the right or left, and an operation signal generation unit that inputs an operation amount of the slewing operation lever to the controller 100.

The travel operation device is configured by an electric lever device including a travel operation lever for receiving an operation from the operator for moving the lower travelling body 10 forward or backward, and an operation signal generation unit that inputs an operation amount of the travel operation lever to the controller 100.

The controller 100 is configured by, for example, a microcomputer, and includes a cylinder length calculation unit 101, an operation parameter generation unit 102, and a command unit 103.

The cylinder length calculation unit 101 calculates the cylinder length of each of the boom cylinder 26, the arm cylinder 27, and the bucket cylinder 28 based on the attitude information detected by the attitude sensor 116.

The operation parameter generation unit 102 generates an operation parameter related to the operation of the work machine 1. The operation parameter includes the pressure value of each of the boom cylinder 26, which raises and lowers the boom 21, the arm cylinder 27, which swings the arm 22, and the bucket cylinder 28, which swings the bucket 24, the cylinder length of each of the boom cylinder 26, the arm cylinder 27, and the bucket cylinder 28, the operation pressure value of the slewing motor 29, and the slewing angle by the slewing motor 29.

The operation parameter generation unit 102 generates an operation parameter including a sensor value detected at a predetermined time interval within a predetermined period. The predetermined period is, for example, one day, and the predetermined time interval is, for example, 10 minutes. The operation parameter generation unit 102 generates an operation parameter including a sensor value detected every 10 minutes during one day. The predetermined period and the predetermined time interval are not limited to the above.

The command unit 103 controls the operation of each element included in the hydraulic circuit 119. The command unit 103 includes a boom command unit, an arm command unit, a bucket command unit, a slewing command unit, and a travel command unit.

The boom command unit inputs a boom command signal of a value corresponding to the operation amount of the boom operation device to the pair of boom solenoid valves 31. Thus, the flow rate of the hydraulic oil supplied to the boom cylinder 26 increases as the operation amount of the boom operation device increases.

The arm command unit inputs an arm command signal of a value corresponding to the operation amount of the arm operation device to the pair of arm solenoid valves 32. Thus, the flow rate of the hydraulic oil supplied to the arm cylinder 27 increases as the operation amount of the arm operation device increases.

The bucket command unit inputs a bucket command signal of a value corresponding to the operation amount of the bucket operation device to the pair of bucket solenoid valves 33. Thus, the flow rate of the hydraulic oil supplied to the bucket cylinder 28 increases as the operation amount of the bucket operation device increases.

The slewing command unit inputs a slewing command signal of a value corresponding to the operation amount of the slewing operation device to the slewing solenoid valve 34. Thus, the flow rate of the hydraulic oil supplied to the slewing motor 29 increases as the operation amount of the slewing operation device increases.

The travel command unit inputs a travel command signal of a value corresponding to the operation amount of the travel operation device to the pair of travel solenoid valves 35L and the pair of travel solenoid valves 35R. Thus, the flow rate of the hydraulic oil supplied to the travel motors 30L and 30R increases as the operation amount of the travel operation device increases.

The communication unit 118 includes an operation parameter transmission unit 106. The operation parameter transmission unit 106 transmits, to the server 2, the operation parameter generated by the operation parameter generation unit 102.

In the present embodiment, the operation device 117 operates the solenoid valves 31 to 35 of the hydraulic circuit 119 via the controller 100, but the present disclosure is not particularly limited thereto, and the operation device 117 may be a remote control valve, which is a hydraulic device that outputs a pressure corresponding to a lever operation amount. In this case, the command unit 103 and the solenoid valves 31 to 35 are unnecessary, and the pilot pressure (boom pilot pressure, arm pilot pressure, bucket pilot pressure, slewing pilot pressure, and travel pilot pressure) output from the operation device 117 is input to the control valves 36 to 40. Pressure oil is supplied to the operation device 117 from a pilot pump. The operation device 117 reduces the pressure of the supplied pressure oil to a pressure corresponding to the lever operation amount, and outputs it as a pilot pressure to the control valves 36 to 40. A pressure sensor is installed in the hydraulic piping connecting the operation device 117 and the control valves 36 to 40. The pressure sensor detects the pressure value of the pilot pressure output from the operation device 117 to the control valves 36 to 40, and inputs the signal of the detected pressure value to the controller 100. The controller 100 handles the pressure value signal input from the pressure sensor as an operation command signal (boom command signal, arm command signal, bucket command signal, slewing command signal, and travel command signal).

Figure 4:
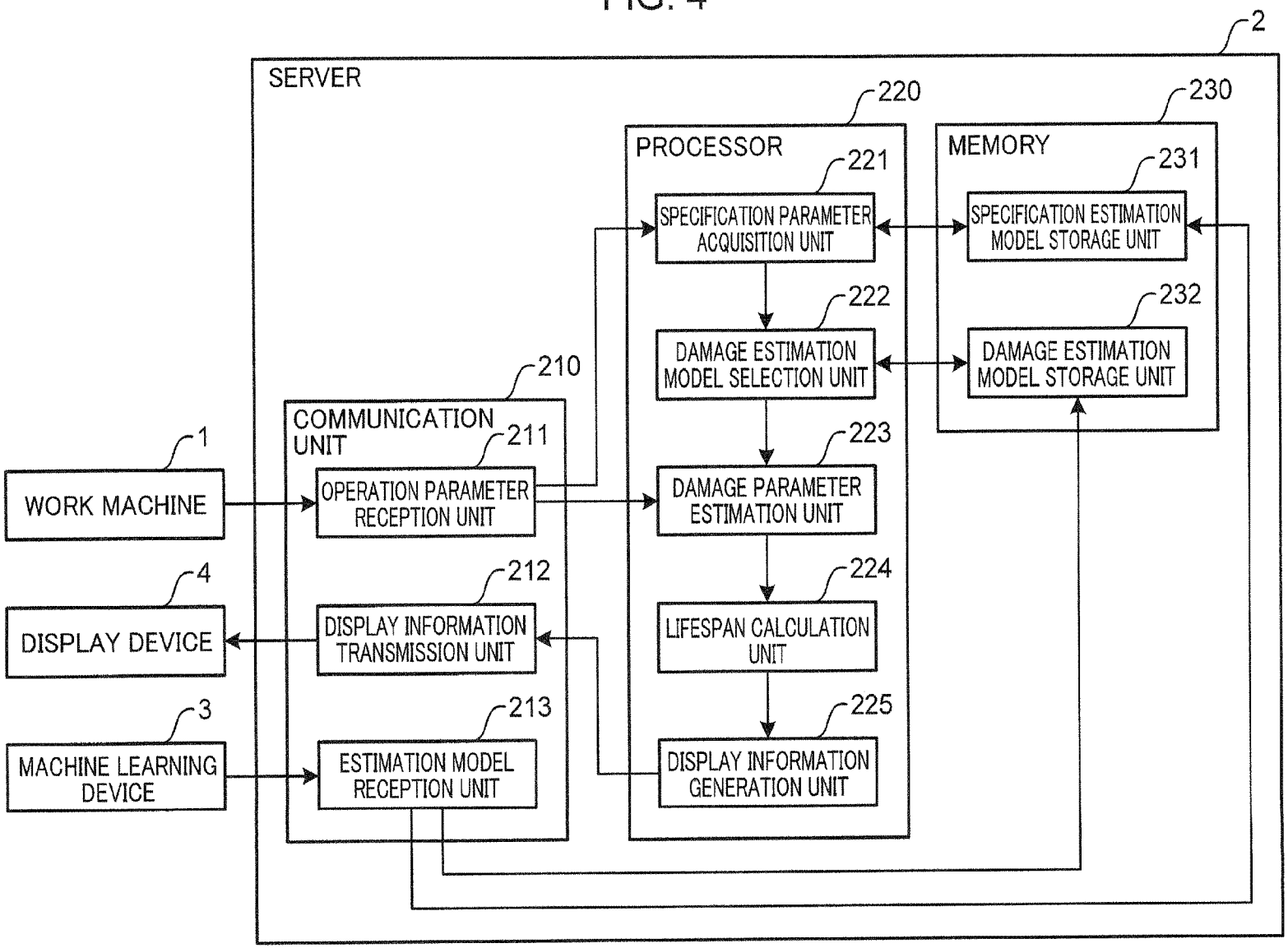
FIG. 4 is a block diagram showing a configuration of a server according to the first embodiment of the present disclosure.

FIG. 4 is a block diagram showing the configuration of the server according to the first embodiment of the present disclosure.

The server 2 shown in FIG. 4 is an example of a damage estimation device. The server 2 includes a communication unit 210, a processor 220, and a memory 230.

The communication unit 210 includes an operation parameter reception unit 211, a display information transmission unit 212, and an estimation model reception unit 213. The processor 220 includes a specification parameter acquisition unit 221, a damage estimation model selection unit 222, a damage parameter estimation unit 223, a lifespan calculation unit 224, and a display information generation unit 225. The memory 230 includes a specification estimation model storage unit 231 and a damage estimation model storage unit 232.

The operation parameter reception unit 211 acquires an operation parameter related to the operation of the work machine 1. The operation parameter reception unit 211 receives the operation parameter transmitted by the work machine 1.

The specification estimation model storage unit 231 stores a specification estimation model constructed by machine learning using training data with the operation parameter as an input value and a specification parameter as an output value. Here, the specification parameter includes the length of the boom 21, the length of the arm 22, and the capacity of the bucket 24.

The damage estimation model storage unit 232 stores a damage estimation model constructed by machine learning using training data with the operation parameter as an input value and a damage parameter related to damage in the predetermined portion of the work machine 1 as an output value. The damage estimation model storage unit 232 stores a plurality of damage estimation models different for each specification of the work machine. The damage estimation model storage unit 232 stores each of a plurality of specification parameters related to the specification of the work machine and each of the plurality of damage estimation models in association with each other.

FIG. 5 is a view showing an example of the plurality of damage estimation models stored in the damage estimation model storage unit in the first embodiment.

For example, the damage estimation model storage unit 232 stores the first to sixth damage estimation models different for each specification parameter. The first damage estimation model is associated with a specification parameter in which, for example, the length of the boom 21 is 6 m, the length of the arm 22 is 3 m, and the capacity of the bucket 24 is 1 $m^3$. The first damage estimation model is generated by machine learning using, as training data, the operation parameter and damage parameter obtained from a testing machine of the work machine in which the length of the boom 21 is 6 m, the length of the arm 22 is 3 m, and the capacity of the bucket 24 is 1 $m^3$.

Similarly, the second damage estimation model is associated with a specification parameter in which, for example, the length of the boom 21 is 6 m, the length of the arm 22 is 2 m, and the capacity of the bucket 24 is 1 $m^3$. The third damage estimation model is associated with a specification parameter in which, for example, the length of the boom 21 is 6 m, the length of the arm 22 is 4 m, and the capacity of the bucket 24 is 1 $m^3$. The fourth damage estimation model is associated with a specification parameter in which, for example, the length of the boom 21 is 6 m, the length of the arm 22 is 3 m, and the capacity of the bucket 24 is 1.2 $m^3$. The fifth damage estimation model is associated with a specification parameter in which, for example, the length of the boom 21 is 6 m, the length of the arm 22 is 2 m, and the capacity of the bucket 24 is 1.5 $m^3$. The sixth damage estimation model is associated with a specification parameter in which, for example, the length of the boom 21 is 6 m, the length of the arm 22 is 4 m, and the capacity of the bucket 24 is 0.8 $m^3$.

The number of damage estimation models stored in the damage estimation model storage unit 232 is not limited to six shown in FIG. 5. The damage estimation model storage unit 232 may store five or less or seven or more damage estimation models. The value of the specification parameter is not limited to the above.

The specification parameter acquisition unit 221 acquires a specification parameter of the work machine 1 to be estimated. Here, the specification parameter acquisition unit 221 estimate the specification parameter of the work machine 1 by inputting the operation parameter acquired by the operation parameter reception unit 211 to the specification estimation model stored in the specification estimation model storage unit 231.

For example, if the bucket capacity is different, the amount of soil put into the bucket becomes different, and the forces of the boom and arm required to lift the bucket also becomes different. If the bucket capacity is larger than the standard, the amount of soil put into the bucket increases, and the pressure of the boom cylinder and the arm cylinder that drive the boom and the arm becomes higher than the standard. Similarly, if the bucket capacity is smaller than the standard, the amount of soil put into the bucket decreases, and the pressure of the boom cylinder and the arm cylinder that drive the boom and arm becomes lower than the standard. When the length of the boom or the length arm changes, the position of the tip end of the bucket changes. Therefore, the timing at which a work machine having a boom or arm of a standard length starts digging soil is different from the timing at which a work machine having a boom or arm longer than the standard starts digging soil.

Thus, changes in specification parameters such as the boom length, the arm length, and the bucket capacity may affect operation parameters such as the pressure values and lengths of each of the boom cylinder, arm cylinder, and bucket cylinder. That is, there is a certain correlation between the specification parameter and the operation parameter. Therefore, the specification parameter acquisition unit 221 can acquire the specification parameter of the work machine as an estimation value by acquiring a specification estimation model obtained through machine learning with the operation parameter and the specification parameter as training data, and inputting the operation parameter of the work machine to the acquired specification estimation model.

The damage estimation model selection unit 222 selects a damage estimation model associated with the specification parameter acquired by the specification parameter acquisition unit 221 from among a plurality of damage estimation models stored in the damage estimation model storage unit 232.

For example, if the specification parameter acquisition unit 221 acquires a specification parameter in which the length of the boom 21 is 6 m, the length of the arm 22 is 3 m, and the bucket capacity 24 is 1.2 $m^3$, the damage estimation model selection unit 222 selects the fourth damage estimation model from among the plurality of damage estimation models shown in FIG. 5.

If the damage estimation model associated with the same specification parameter as the specification parameter acquired by the specification parameter acquisition unit 221 is not stored in the damage estimation model storage unit 232, the damage estimation model selection unit 222 selects the damage estimation model associated with the specification parameter closest to the specification parameter acquired by the specification parameter acquisition unit 221. For example, if the specification parameter acquisition unit 221 acquires a specification parameter in which the length of the boom 21 is 6 m, the length of the arm 22 is 4.5 m, and the bucket capacity 24 is 0.6 $m^3$, the damage estimation model associated with the same specification parameter as that specification parameter does not exist in the plurality of damage estimation models shown in FIG. 5. In this case, the damage estimation model selection unit 222 selects, from among the plurality of damage estimation models shown in FIG. 5, the sixth damage estimation model associated with the specification parameter closest to the specification parameter acquired by the specification parameter acquisition unit 221.

Thus, from among the plurality of damage estimation models stored in the damage estimation model storage unit 232, the damage estimation model associated with the specification parameter closest to the specification parameter acquired by the specification parameter acquisition unit 221 is selected. Therefore, even if there is no damage estimation model associated with the same specification parameter as the specification parameter of the work machine to be estimated, it is possible to select the optimum damage estimation model. It is possible to reduce the number of damage estimation models stored in advance, and it is possible to reduce the capacity of the memory 230.

The damage parameter estimation unit 223 estimates the damage parameter by inputting the operation parameter acquired by the operation parameter reception unit 211 to the damage estimation model stored in a damage estimation model storage unit 232. Here, the damage parameter estimation unit 223 estimates the damage parameter by inputting the operation parameter acquired by the operation parameter reception unit 211 to the damage estimation model selected by the damage estimation model selection unit 222. The damage parameter is a stress generated in a predetermined portion of the work machine at a unit time (e.g., one day or one hour), for example. The predetermined portion is, for example, the boom 21 and/or the arm 22.

In general, the work machine 1 such as a hydraulic excavator repeatedly performs the work of excavating by operating the work device 14 and discharging soil by slewing the upper slewing body 12. Therefore, changes in operation parameters such as the pressure value of each of the boom cylinder 26, the arm cylinder 27, and the bucket cylinder 28, the cylinder length of each of the boom cylinder 26, the arm cylinder 27, and the bucket cylinder 28, the operation pressure value of the slewing motor 29, and the slewing angle by the slewing motor 29 may affect damage parameters such as the stress generated in a predetermined portion of the work machine 1. That is, there is a certain correlation between the operation parameter and the damage parameter. Therefore, the damage parameter estimation unit 223 can acquire the damage parameter of the work machine 1 as an estimation value by inputting the operation parameter of the work machine 1 to the damage estimation model obtained through machine learning with the operation parameter and the damage parameter as training data.

The lifespan calculation unit 224 calculates the lifespan of the work machine 1 based on the damage parameter estimated by the damage parameter estimation unit 223. The lifespan calculation unit 224 performs frequency analysis of stress by the rainflow method from a time change of the stress generated in a predetermined portion of the work machine estimated by the damage parameter estimation unit 223. The lifespan calculation unit 224 calculates the degree of damage increased in a unit time by using the Miner's rule from the analysis result. The lifespan calculation unit 224 calculates the degree of damage up to the present time by adding the calculated degree of damage to the degree of damage having been calculated up to the previous time. The lifespan calculation unit 224 calculates the remaining lifespan by subtracting the degree of damage up to the present time from the design lifespan of the work machine. The lifespan calculation unit 224 is capable of calculating the lifespan by using various conventional techniques.

In the first embodiment, the damage parameter estimation unit 223 estimates the stress generated in a predetermined portion of the work machine 1 as a damage parameter, but the present disclosure is not particularly limited thereto. The damage parameter estimation unit 223 may estimate the strain in a predetermined portion of the work machine 1 as a damage parameter, or may estimate the lifespan amount of a predetermined portion of the work machine 1 as a damage parameter. When estimating the strain in a predetermined portion of the work machine 1, the damage parameter estimation unit 223 calculates stress from the estimated strain. When the damage parameter estimation unit 223 estimates the lifespan amount of a predetermined portion of the work machine 1 as a damage parameter, the lifespan calculation unit 224 becomes unnecessary.

The display information generation unit 225 generates display information for presenting, to the manager, the lifespan of the work machine 1 calculated by the lifespan calculation unit 224.

The display information transmission unit 212 transmits the display information generated by the display information generation unit 225 to the display device 4.

The estimation model reception unit 213 receives the specification estimation model and the damage estimation model transmitted by the machine learning device 3. The estimation model reception unit 213 stores the received specification estimation model in the specification estimation model storage unit 231, and stores the received damage estimation model in the damage estimation model storage unit 232.

Figure 6:
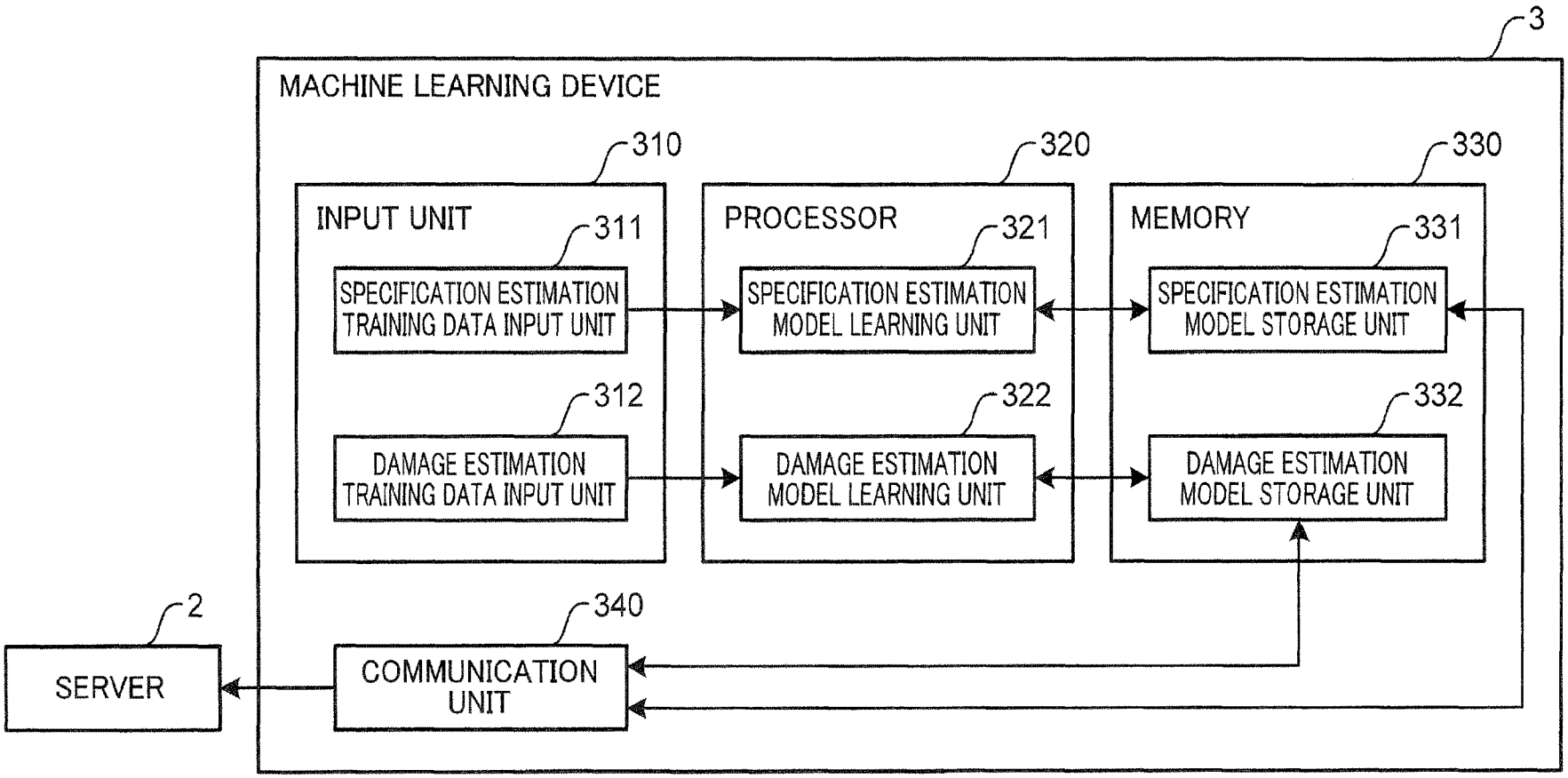
FIG. 6 is a block diagram showing a configuration of a machine learning device according to the first embodiment of the present disclosure.

FIG. 6 is a block diagram showing the configuration of the machine learning device according to the first embodiment of the present disclosure.

The machine learning device 3 shown in FIG. 6 includes an input unit 310, a processor 320, a memory 330, and a communication unit 340.

The input unit 310 is an input interface, for example, and includes a specification estimation training data input unit 311 and a damage estimation training data input unit 312.

The specification estimation training data input unit 311 inputs specification estimation training data including an operation parameter related to the operation of the work machine and a specification parameter related to the specification of the work machine, which are obtained when the work machine operates.

The damage estimation training data input unit 312 inputs damage estimation training data including an operation parameter related to the operation of the work machine and a damage parameter related to the damage in a predetermined portion of the work machine, which are obtained when the work machine operates. The operation parameter and the damage parameter included in the damage estimation training data are obtained from the measurement instrument included in the testing machine of the work machine. The measurement instrument included in the testing machine of the work machine detects strain or stress of a predetermined portion as a damage parameter. The damage parameter may also include strain or stress in a plurality of predetermined portions. The damage estimation training data includes the specification parameter of the work machine that measured the operation parameter and the damage parameter.

The specification estimation training data input unit 311 and the damage estimation training data input unit 312 may acquire, from the communication unit 340, the specification estimation training data and the damage estimation training data received from an external device via a network such as the Internet, may acquire, from a drive device, the specification estimation training data and the damage estimation training data stored in a recording medium such as an optical disk, or may acquire the specification estimation training data and the damage estimation training data from an auxiliary storage device such as a universal serial bus (USB) memory. Furthermore, the specification estimation training data input unit 311 and the damage estimation training data input unit 312 may acquire the specification estimation training data and the damage estimation training data input by the user from an input device such as a keyboard, a mouse, or a touch screen.

The memory 330 includes a specification estimation model storage unit 331 and a damage estimation model storage unit 332.

The specification estimation model storage unit 331 stores a specification estimation model having the operation parameter as an input value and the specification parameter as an output value.

The damage estimation model storage unit 332 stores a damage estimation model having the operation parameter as an input value and the damage parameter as an output value. The damage estimation model storage unit 332 stores a plurality of damage estimation models different for each specification of the work machine. The damage estimation model storage unit 332 stores each of a plurality of specification parameters related to the specification of the work machine and each of the plurality of damage estimation models in association with each other.

The processor 320 includes a specification estimation model learning unit 321 and a damage estimation model learning unit 322.

The specification estimation model learning unit 321 inputs an operation parameter included in the specification estimation training data input by the specification estimation training data input unit 311 to a specification estimation model read from the specification estimation model storage unit 331, and performs machine learning on the specification estimation model so as to minimize the error between the specification parameter output from the specification estimation model and the specification parameter included in the specification estimation training data. The specification estimation model learning unit 321 can improve the estimation accuracy of the specification parameter by performing machine learning of the specification estimation model by using more specification estimation training data.

The damage estimation model learning unit 322 inputs an operation parameter included in damage estimation training data input by the damage estimation training data input unit 312 to a damage estimation model read from the damage estimation model storage unit 332, and performs machine learning on the damage estimation model so as to minimize the error between the damage parameter output from the damage estimation model and the damage parameter included in the damage estimation training data. The damage estimation model learning unit 322 can improve the estimation accuracy of the damage parameter by performing machine learning of the damage estimation model by using more damage estimation training data.

The damage estimation model learning unit 322 selects the damage estimation model associated with the specification parameter included in the damage estimation training data input by the damage estimation training data input unit 332 from among a plurality of damage estimation models stored in the damage estimation model storage unit 312, and performs machine learning on the selected damage estimation model.

For the specification estimation model and the damage estimation model, for example, a deep neural network or a convolutional neural network in a deep learning method may be used, or a support vector machine or a mixed Gaussian distribution in a statistical method may be used. For the machine learning of the specification estimation model and the damage estimation model, a learning method tailored for the model to be used, such as error backpropagation method or maximum likelihood estimation, is used.

The communication unit 340 reads the learned specification estimation model from the specification estimation model storage unit 331 and transmits the read specification estimation model to the server 2. The communication unit 340 reads the learned damage estimation model from the damage estimation model storage unit 332 and transmits the read damage estimation model to the server 2.

The display device 4 is, for example, a smartphone, a tablet computer or a personal computer, and displays the display information transmitted by the server 2. The display device 4 is used, for example, by the manager of the work machine 1. The display device 4 display s display information for presenting the lifespan of the work machine 1 to the manager.

The display device 4 may be, for example, a liquid crystal display device, and the work machine 1 may include the display device 4. In this case, the communication unit 118 of the work machine 1 may receive the display information transmitted by the server 2.

The work machine 1 may include the display information transmission unit 212, the estimation model reception unit 213, the specification parameter acquisition unit 221, the damage estimation model selection unit 222, the damage parameter estimation unit 223, the lifespan calculation unit 224, the display information generation unit 225, the specification estimation model storage unit 231, and the damage estimation model storage unit 232 of the server 2. In this case, the damage estimation system may not include the server 2.

Subsequently, the operation of the server 2 in the first embodiment will be described.

Figure 7:
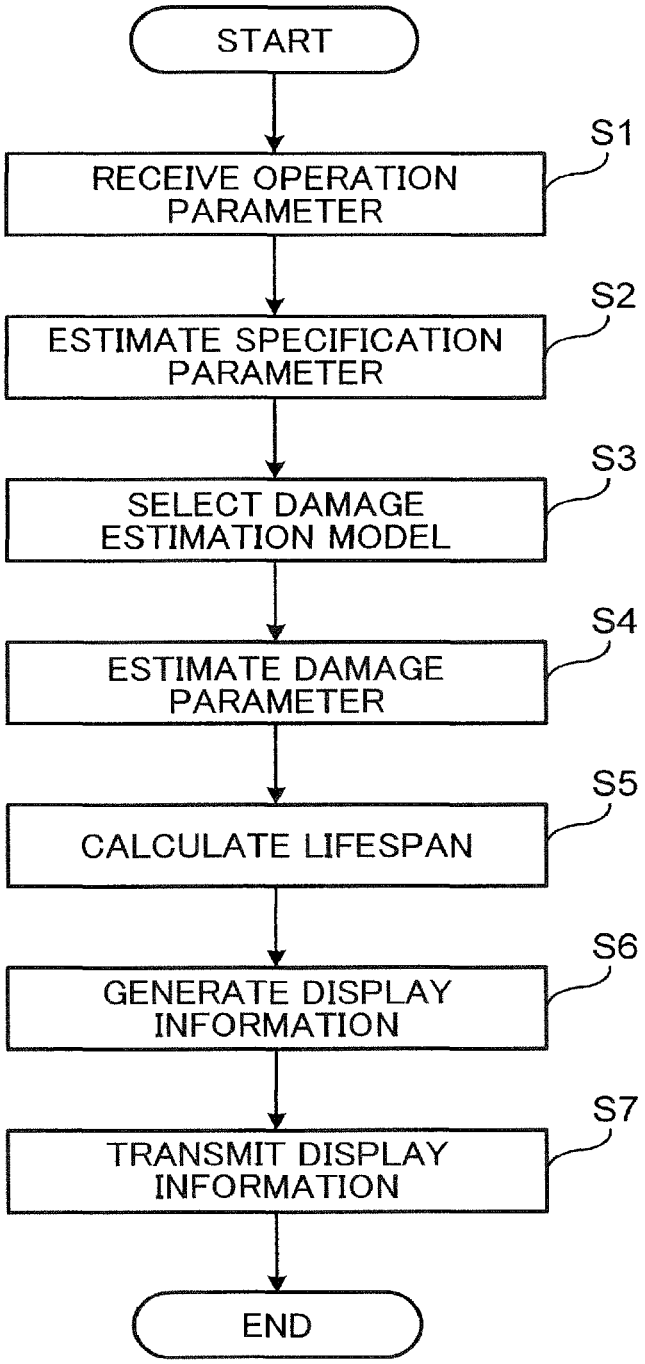
FIG. 7 is a flowchart for explaining the operation of the server according to the first embodiment of the present disclosure.

FIG. 7 is a flowchart for explaining the operation of the server according to the first embodiment of the present disclosure.

First, in step S1, the operation parameter reception unit 211 receives the operation parameter transmitted by the work machine 1.

Next, in step S2, the specification parameter acquisition unit 221 estimates the specification parameter of the work machine 1 by reading the specification estimation model stored in the specification estimation model storage unit 231, and inputting the operation parameter received by the operation parameter reception unit 211 to the read specification estimation model.

Next, in step S3, the damage estimation model selection unit 222 selects the damage estimation model associated with the specification parameter estimated by the specification parameter acquisition unit 221 from among the plurality of damage estimation models stored in the damage estimation model storage unit 232.

Next, in step S4, the damage parameter estimation unit 223 estimates the damage parameter by inputting the operation parameter received by the operation parameter reception unit 211 to the damage estimation model selected by the damage estimation model selection unit 222.

Next, in step S5, the lifespan calculation unit 224 calculates the lifespan of the work machine 1 based on the damage parameter estimated by the damage parameter estimation unit 223.

Next, in step S6, the display information generation unit 225 generates display information for presenting, to the manager, the lifespan of the work machine 1 calculated by the lifespan calculation unit 224.

Next, in step S7, the display information transmission unit 212 transmits the display information generated by the display information generation unit 225 to the display device 4. The display device 4 receives the display information transmitted by the server 2 and displays the received display information. This allows the manager of the work machine 1 to know the lifespan of the work machine 1.

Thus, since the damage parameter is estimated by inputting the acquired operation parameter to a damage estimation model constructed by machine learning using training data with the operation parameter related to the operation of the work machine as an input value and the damage parameter related to the damage in a predetermined portion of the work machine as an output value, it is possible to accurately and easily estimate the lifespan of the work machine from the estimated damage parameter.

In the first embodiment, the display information generation unit 225 generates display information for presenting, to the manager, the lifespan of the work machine 1 calculated by the lifespan calculation unit 224, but the present disclosure is not particularly limited thereto, and the display information generation unit 225 may generate display information for presenting, to the manager, the stress generated in a predetermined portion of the work machine 1 estimated by the damage parameter estimation unit 223. When the strain in a predetermined portion of the work machine is estimated as a damage parameter, the display information generation unit 225 may generate display information for presenting, to the manager, the strain in the predetermined portion of the work machine 1 estimated by the damage parameter estimation unit 223.

The display information transmission unit 212 may transmit the damage parameter estimated by the damage parameter estimation unit 223 to the display device 4 communicatively connected with the server 2. In this case, the display information transmission unit 212 acquires, from the damage parameter estimation unit 223, a damage parameter including any of the strain in a predetermined portion of the work machine 1, the stress generated in a predetermined portion of the work machine 1, and the lifespan amount of a predetermined portion of the work machine 1, and transmits the acquired damage parameter to the display device 4.

In the first embodiment, the memory 230 may further include a damage parameter storage unit that stores the damage parameter estimated by the damage parameter estimation unit 223. The damage parameter storage unit may store the damage parameter as log information. In this case, the display device 4 may transmit, to the server 2, an acquisition request for acquiring a past damage parameter. The communication unit 210 of the server 2 may read a past damage parameter from the damage parameter storage unit in response to the acquisition request from the display device 4, and transmit the read past damage parameter to the display device 4.

Subsequently, the specification estimation model learning processing and the damage estimation model learning processing of the machine learning device 3 according to the first embodiment of the present disclosure will be described.

Figure 8:
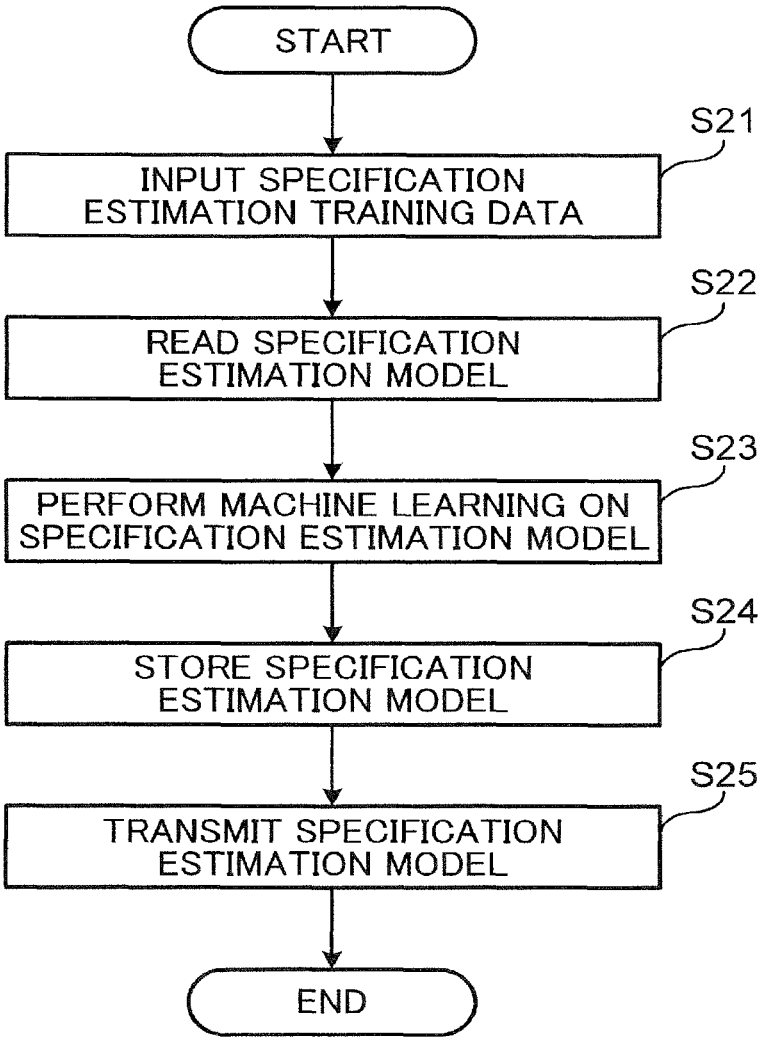
FIG. 8 is a flowchart for explaining specification estimation model learning processing of the machine learning device according to the first embodiment of the present disclosure.

FIG. 8 is a flowchart for explaining the specification estimation model learning processing of the machine learning device according to the first embodiment of the present disclosure.

First, in step S21, the specification estimation training data input unit 311 inputs specification estimation training data including an operation parameter related to the operation of the work machine and a specification parameter related to the specification of the work machine, which are obtained when the work machine operates.

Next, in step S22, the specification estimation model learning unit 321 reads the specification estimation model from the specification estimation model storage unit 331.

Next, in step S23, the specification estimation model learning unit 321 inputs an operation parameter included in the specification estimation training data input by the specification estimation training data input unit 311 to a specification estimation model read from the specification estimation model storage unit 331, and performs machine learning on the specification estimation model so as to minimize the error between the specification parameter output from the specification estimation model and the specification parameter included in the specification estimation training data.

If a plurality of pieces of specification estimation training data are input, the specification estimation model learning unit 321 repeatedly performs the processing of step S23 until the machine learning of the specification estimation model using all the specification estimation training data ends.

Next, in step S24, the specification estimation model learning unit 321 stores, in the specification estimation model storage unit 331, the specification estimation model obtained through machine learning.

Next, in step S25, the communication unit 340 reads the learned specification estimation model from the specification estimation model storage unit 331, and transmits the read specification estimation model to the server 2. The estimation model reception unit 213 of the server 2 receives the specification estimation model transmitted by the machine learning device 3 and stores the received specification estimation model in the specification estimation model storage unit 231.

If machine learning has been performed on the specification estimation model, the communication unit 340 may transmit the specification estimation model to the server 2, or may periodically transmit the specification estimation model to the server 2 regardless of whether or not machine learning has been performed on the specification estimation model.

Figure 9:
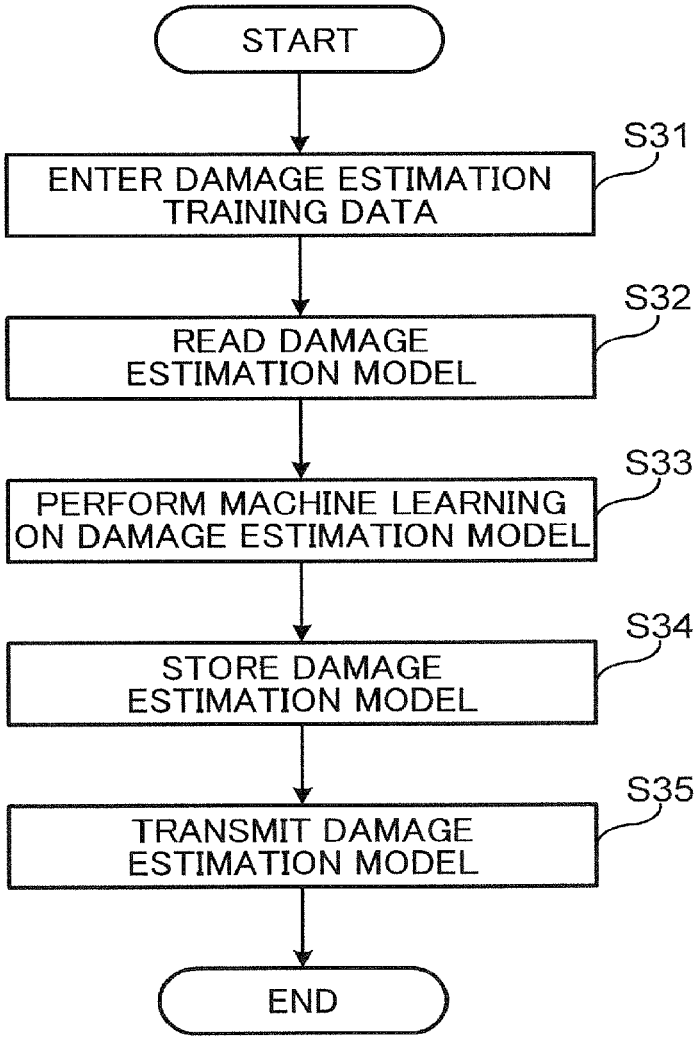
FIG. 9 is a flowchart for explaining damage estimation model learning processing of the machine learning device according to the first embodiment of the present disclosure.

FIG. 9 is a flowchart for explaining the damage estimation model learning processing of the machine learning device according to the first embodiment of the present disclosure.

First, in step S31, the damage estimation training data input unit 312 inputs damage estimation training data including an operation parameter related to the operation of the work machine, a damage parameter related to the damage in a predetermined portion of the work machine, and a specification parameter of the work machine that measured the operation parameter and the damage parameter, which are obtained when the work machine operates.

Next, in step S32, the damage estimation model learning unit 322 reads the damage estimation model associated with the specification parameter included in the damage estimation training data input by the damage estimation training data input unit 312 from among the plurality of damage estimation models stored in the damage estimation model storage unit 332.

Next, in step S33, the damage estimation model learning unit 322 inputs an operation parameter included in damage estimation training data input by the damage estimation training data input unit 312 to a damage estimation model read from the damage estimation model storage unit 332, and performs machine learning on the damage estimation model so as to minimize the error between the damage parameter output from the damage estimation model and the damage parameter included in the damage estimation training data.

Next, in step S34, the damage estimation model learning unit 322 stores, in the damage estimation model storage unit 332, the damage estimation model obtained through machine learning.

If a plurality of pieces of damage estimation training data are input, the damage estimation model learning unit 322 repeatedly performs the processing of steps S32 to S34 until the machine learning of the damage estimation model using all the damage estimation training data ends.

Next, in step S35, the communication unit 340 reads the learned damage estimation model from the damage estimation model storage unit 332 and transmits the read damage estimation model to the server 2. The estimation model reception unit 213 of the server 2 receives the damage estimation model transmitted by the machine learning device 3 and stores the received damage estimation model in the damage estimation model storage unit 232.

If machine learning has been performed on the damage estimation model, the communication unit 340 may transmit the damage estimation model to the server 2, or may periodically transmit the damage estimation model to the server 2 regardless of whether or not machine learning has been performed on the damage estimation model.

Thus, since an operation parameter included in the training data is input to a damage estimation model having an operation parameter related to the operation of the work machine as an input value and a damage parameter related to the damage in a predetermined portion of the work machine as an output value, and machine learning is performed on the damage estimation model so as to minimize the error between the damage parameter output from the damage estimation model and the damage parameter included in the training data, it is possible to accurately and easily estimate the lifespan of the work machine from the estimated damage parameter by inputting the acquired operation parameter to a damage estimation model constructed by machine learning using training data.

In the first embodiment, the operation parameter includes the pressure value of each of the boom cylinder 26, the arm cylinder 27, and the bucket cylinder 28, the cylinder length of each of the boom cylinder 26, the arm cylinder 27, and the bucket cylinder 28, the operation pressure value of the slewing motor 29, and the slewing angle by the slewing motor 29, but the present disclosure is not particularly limited thereto. The operation parameter may include the speed of each of the boom cylinder 26, the arm cylinder 27, and the bucket cylinder 28 or the acceleration of each of the boom cylinder 26, the arm cylinder 27, and the bucket cylinder 28. The speed of each of the boom cylinder 26, the arm cylinder 27, and the bucket cylinder 28 can be calculated by differentiating the length of the boom cylinder 26, the arm cylinder 27, and the bucket cylinder 28, respectively. The acceleration of each of the boom cylinder 26, the arm cylinder 27, and the bucket cylinder 28 can be calculated by differentiating the speed of the boom cylinder 26, the arm cylinder 27, and the bucket cylinder 28, respectively. The operation parameter may include the angular velocity of the slewing motor 29 or the angular acceleration of the slewing motor 29. The angular velocity of the slewing motor 29 can be calculated by differentiating the slewing angle of the slewing motor 29. The angular acceleration of the slewing motor 29 can be calculated by differentiating the angular velocity of the slewing motor 29.

The operation parameter may include the operation pressure values of the travel motors 30L and 30R and the rotation angles of the travel motors 30L and 30R. In this case, the work machine 1 may further include a left travel motor pressure sensor, a right travel motor pressure sensor, a left travel motor rotation angle sensor, and a right travel motor rotation angle sensor.

The left travel motor pressure sensor detects the operation pressure value of the travel motor 30L, i.e., the motor differential pressure. Specifically, the left travel motor pressure sensor includes a first port pressure sensor and a second port pressure sensor. The first port pressure sensor detects first port pressure, which is the pressure of hydraulic oil in one of the pair of ports of the travel motor 30L. The second port pressure sensor detects second port pressure, which is the pressure of hydraulic oil in the other of the pair of ports of the travel motor 30L. The left travel motor pressure sensor converts the differential pressure between the detected first port pressure and second port pressure into a detection signal that is an electric signal corresponding to this, and inputs the detection signal to the controller 100.

The right travel motor pressure sensor detects the operation pressure value of the travel motor 30R, i.e., the motor differential pressure. Specifically, the right travel motor pressure sensor includes a third port pressure sensor and a fourth port pressure sensor. The third port pressure sensor detects third port pressure, which is the pressure of hydraulic oil in one of the pair of ports of the travel motor 30R. The fourth port pressure sensor detects fourth port pressure, which is the pressure of hydraulic oil in the other of the pair of ports of the travel motor 30R. The right travel motor pressure sensor converts the differential pressure between the detected third port pressure and fourth port pressure into a detection signal that is an electric signal corresponding to this, and inputs the detection signal to the controller 100.

The left travel motor rotation angle sensor is configured by, for example, a resolver or a rotary encoder, and detects the rotation angle of the travel motor 30L. The left travel motor rotation angle sensor converts the detected rotation angle into a detection signal that is an electric signal corresponding to this, and inputs the detection signal to the controller 100. The right travel motor rotation angle sensor is configured by, for example, a resolver or a rotary encoder, and detects the rotation angle of the travel motor 30R. The right travel motor rotation angle sensor converts the detected rotation angle into a detection signal that is an electric signal corresponding to this, and inputs the detection signal to the controller 100.

The operation parameter may include the angular velocity of the travel motors 30L and 30R or the angular acceleration of the travel motors 30L and 30R. The angular velocity of the travel motors 30L and 30R can be calculated by differentiating the rotation angle of the travel motors 30L and 30R. The angular acceleration of the travel motors 30L and 30R can be calculated by differentiating the angular velocity of the travel motors 30L and 30R.

In the first embodiment, the operation parameter may further include discharge pressure (pump pressure) of a hydraulic pump connected to an engine (not illustrated) that is a drive source and driven by power output from the engine to discharge hydraulic oil. In this case, the work machine 1 may further include a pump pressure sensor that detects the discharge pressure (pump pressure) of the hydraulic pump.

In the first embodiment, the operation parameter may include various operation signals such as a boom command signal, an arm command signal, a bucket command signal, a slewing command signal, and a travel command signal that are output from the command unit 103. In this case, the operation parameter generation unit 102 acquires, from the command unit 103, the boom command signal, the arm command signal, the bucket command signal, the slewing command signal, and the travel command signal.

In the first embodiment, if the operation device 117 is a remote control valve, the operation parameter may include signals of various pressure values such as boom pilot pressure, arm pilot pressure, bucket pilot pressure, slewing pilot pressure, and travel pilot pressure that are output from the pressure sensors. In this case, the operation parameter generation unit 102 acquires, from the pressure sensors, signals of various pressure values such as the boom pilot pressure, the arm pilot pressure, the bucket pilot pressure, the slewing pilot pressure, and the travel pilot pressure.

In the first embodiment, the operation parameter may include information indicating the type of bucket.

In the first embodiment, if the work device 14 includes a tip attachment other than a bucket such as a cutter, the operation parameter may include information indicating the type of tip attachment.

The work machine 1 in the first embodiment is a hydraulic excavator, but the present disclosure is not particularly limited thereto, and may be an electric excavator. In this case, the operation parameter may include the voltage or current applied to the motor driving the boom 21, the voltage or current applied to the motor driving the arm 22, the voltage or current applied to the motor driving the bucket 24, and the voltage or current applied to the stewing motor.

In the first embodiment, the display information generation unit 225 may determine whether or not the lifespan calculated by the lifespan calculation unit 224 exceeds a threshold value. If it is determined that the lifespan exceeds the threshold value, the display information generation unit 225 may generate display information for warning the manager. If it is determined that the lifespan does not exceed the threshold value, the display information generation unit 225 may not generate display information for warning the manager.

In the first embodiment, the display information generation unit 225 may determine whether or not the damage parameter estimated by the damage parameter estimation unit 223 exceeds a threshold value. If it is determined that the damage parameter exceeds the threshold value, the display information generation unit 225 may generate display information for warning the manager. If it is determined that the damage parameter does not exceed the threshold value, the display information generation unit 225 may not generate display information for warning the manager.

Second Embodiment

In the first embodiment, the specification parameter is estimated from the operation parameter using a specification estimation model. Meanwhile, in the second embodiment, the specification parameter is stored in advance.

Figure 10:
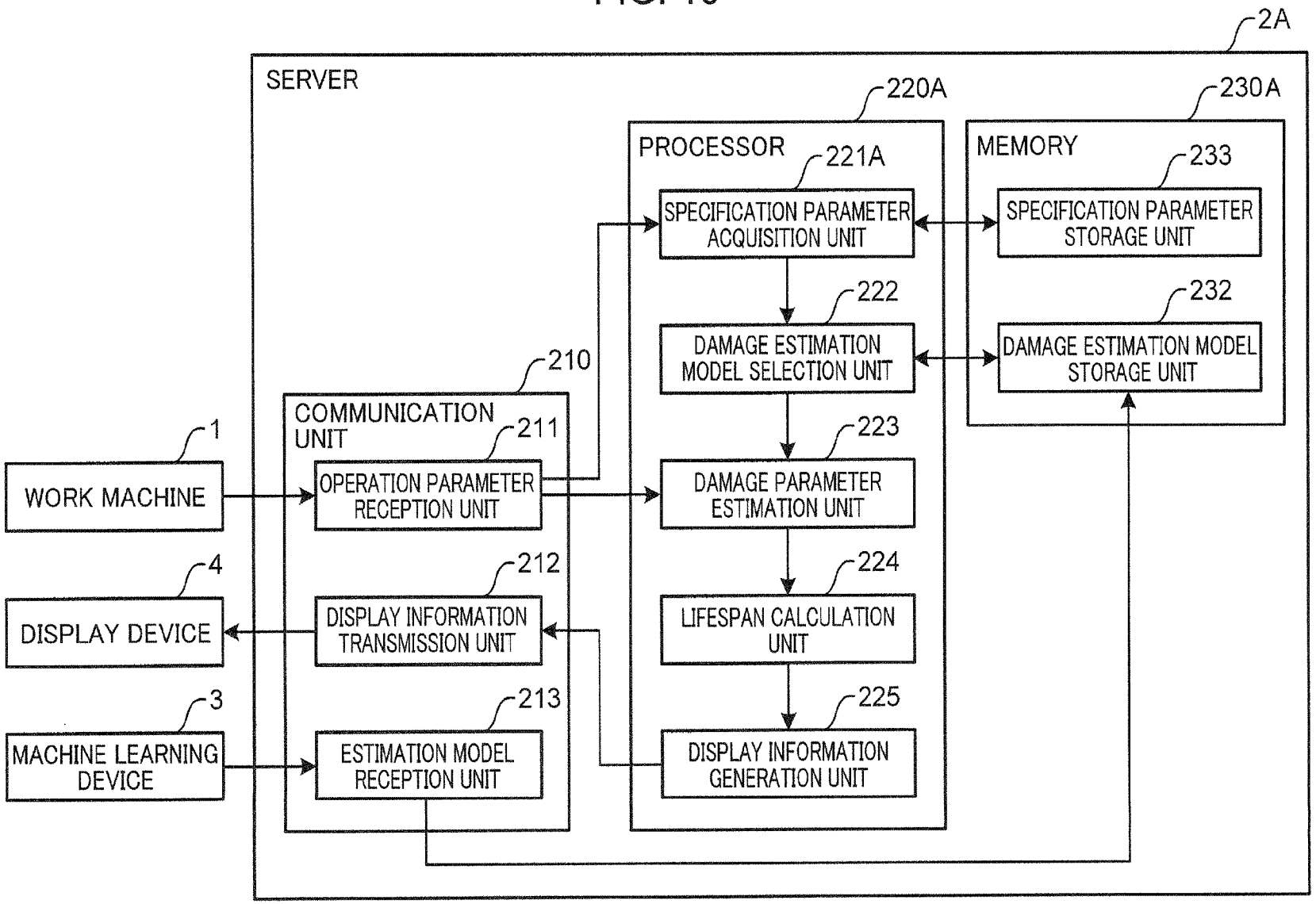
FIG. 10 is a block diagram showing a configuration of a server according to a second embodiment of the present disclosure.

FIG. 10 is a block diagram showing the configuration of the server according to the second embodiment of the present disclosure. The configuration of the damage estimation system, the work machine 1, and the display device 4 according to the second embodiment is the same as that of the first embodiment.

A server 2A shown in FIG. 10 is an example of a damage estimation device. The server 2A includes the communication unit 210, a processor 220A, and a memory 230A. In the second embodiment, the same components as those in the first embodiment are given the same reference numerals, and description thereof will be omitted.

The processor 220A includes a specification parameter acquisition unit 221A, the damage estimation model selection unit 222, the damage parameter estimation unit 223, the lifespan calculation unit 224, and the display information generation unit 225. The memory 230A includes the damage estimation model storage unit 232 and a specification parameter storage unit 233.

The specification parameter storage unit 233 stores a specification parameter of the work machine 1 in advance. The specification parameter storage unit 233 stores in advance a specification parameter in association with identification information for identifying the work machine 1.

When the work machine 1 is newly purchased, the user or a serviceman inputs a specification parameter of the purchased work machine 1 to a terminal device. The terminal device transmits the input specification parameter to the server 2A together with the identification information for identifying the work machine 1. The communication unit 210 of the server 2A receives the specification parameter and identification information transmitted by the terminal device, and stores the received specification parameter into the specification parameter storage unit 233 in association with the identification information.

When the work device 14 of the work machine 1 is replaced, the user or the serviceman inputs, to the terminal device, the specification parameter of the work machine 1 in which the work device 14 has been replaced. The terminal device transmits the input specification parameter to the server 2A together with the identification information for identifying the work machine 1. The communication unit 210 of the server 2A receives the specification parameter and identification information transmitted by the terminal device, and updates the specification parameter associated with the identification information stored in the specification parameter storage unit 233 to the received specification parameter.

The specification parameter acquisition unit 221A acquires, from the specification parameter storage unit 233, a specification parameter of the work machine 1 to be estimated. Here, the operation parameter reception unit 211 receives the identification information of the work machine 1 together with the operation parameter. The specification parameter acquisition unit 221 acquires, from the specification parameter storage unit 233, the specification parameter associated with the identification information received by the operation parameter reception unit 211.

In the second embodiment, unlike the first embodiment, a specification estimation model is unnecessary. Therefore, the machine learning device 3 does not include the specification estimation training data input unit 311, the specification estimation model learning unit 321, and the specification estimation model storage unit 331. The configuration of the damage estimation training data input unit 312, the damage estimation model learning unit 322, and the damage estimation model storage unit 332 in the second embodiment is the same as that in the first embodiment.

In the second embodiment, the specification parameter input by the terminal device is stored in the specification parameter storage unit 233, but the present disclosure is not particularly limited thereto. Each attachment constituting the work device 14 may include an electronic tag that stores information regarding its own specification and transmits information regarding its own specification, and the work machine 1 may include a receiver that receives information transmitted by each electronic tag.

Specifically, the boom 21, the arm 22, and the bucket 24 constituting the work device 14 may each include an electronic tag. The electronic tag included in the boom 21 stores in advance the length of the boom 21, and transmits the stored information regarding the length of the boom 21 to the receiver. The electronic tag included in the arm 22 stores in advance the length of the arm 22, and transmits the stored information regarding the length of the arm 22 to the receiver. The electronic tag included in the bucket 24 stores in advance the capacity of the bucket 24, and transmits the stored information regarding the capacity of the bucket 24 to the receiver. The receiver receives information regarding the length of the boom 21, information regarding the length of the arm 22, and information regarding the capacity of the bucket 24 that are transmitted by each electronic tag, and generates a specification parameter including the length of the boom 21, the length of the arm 22, and the capacity of the bucket 24. The communication unit 118 transmits the generated specification parameter of the work machine 1 to the server 2A together with the identification information for identifying the work machine 1. The communication unit 210 of the server 2A stores, in the specification parameter storage unit 233, the received specification parameter in association with the identification information.

Summary of Embodiments

The technical features of the present embodiments are summarized as follows.

A damage estimation device according to one aspect of the present disclosure is a damage estimation device that estimates damage in a predetermined portion associated with an operation of a work machine, the damage estimation device including: an operation parameter acquisition unit that acquires an operation parameter related to the operation of the work machine; a damage estimation model storage unit that stores a damage estimation model constructed by machine learning using training data with the operation parameter as an input value and a damage parameter related to damage in the predetermined portion of the work machine as an output value; and an estimation unit that estimates the damage parameter by inputting the operation parameter acquired by the operation parameter acquisition unit to the damage estimation model stored in the damage estimation model storage unit.

According to this configuration, since the damage parameter is estimated by inputting the acquired operation parameter to a damage estimation model constructed by machine learning using training data with the operation parameter related to the operation of the work machine as an input value and the damage parameter related to the damage in a predetermined portion of the work machine as an output value, it is possible to accurately and easily estimate the lifespan of the work machine from the estimated damage parameter.

In the damage estimation device described above, the work machine may include a lower travelling body, an upper slewing body mounted on the lower travelling body, a work device including a boom supported on the upper slewing body in a raising and lowering manner, an arm swingably coupled to a tip end of the boom, and a bucket attached to a tip end of the arm and pressed against a construction surface, and a slewing motor that slews the upper slewing body with respect to the lower travelling body, and the operation parameter may include a pressure value of each of a boom cylinder, which raises and lowers the boom, an arm cylinder, which swings the arm, and a bucket cylinder, which swings the bucket, a length of each of the boom cylinder, the arm cylinder, and the bucket cylinder, an operation pressure value of the slewing motor, and a slewing angle by the slewing motor.

According to this configuration, the pressure value of each of the boom cylinder, which raises and lowers the boom, the arm cylinder, which swings the arm, and the bucket cylinder, which swings the bucket, the length of each of the boom cylinder, the arm cylinder, and the bucket cylinder, the operation pressure value of the slewing motor, and the slewing angle by the slewing motor are operation parameters that cause damage in a predetermined portion of the work machine. Therefore, it is possible to accurately estimate the damage parameter by using the pressure value of each of the boom cylinder, the arm cylinder, and the bucket cylinder, the length of each of the boom cylinder, the arm cylinder, and the bucket cylinder, the operation pressure value of the slewing motor, and the slewing angle by the slewing motor.

In the damage estimation device described above, the damage parameter may include any of strain in the predetermined portion of the work machine, stress generated in the predetermined portion of the work machine, and a lifespan amount of the predetermined portion of the work machine.

According to this configuration, it is possible to estimate, as a damage parameter, any of the strain in a predetermined portion of the work machine, the stress generated in a predetermined portion of the work machine, and the lifespan amount of a predetermined portion of the work machine.

In the damage estimation device described above, the damage estimation model may include a plurality of damage estimation models different for each specification of the work machine, the damage estimation model storage unit may store each of a plurality of specification parameters related to a specification of the work machine and each of the plurality of damage estimation models in association with each other, the damage estimation device may further include a specification parameter acquisition unit that acquires a specification parameter of a work machine to be estimated, and a selection unit that selects a damage estimation model associated with the specification parameter acquired by the specification parameter acquisition unit from among the plurality of damage estimation models, and the estimation unit may estimate the damage parameter by inputting the operation parameter acquired by the operation parameter acquisition unit into the damage estimation model selected by the selection unit.

If the specifications of work machines are different, operation parameters detected from the work machines are also different. It is difficult to estimate damage parameters of various work machines having different specifications from a single damage estimation model. However, since the damage estimation model associated with the acquired specification parameter is selected from among the plurality of damage estimation models associated with each of the plurality of specification parameters related to the specification of the work machine, it is possible to estimate a more accurate damage parameter in accordance with the specification of the work machine.

In the damage estimation device described above, the damage estimation device may further include a specification estimation model storage unit that stores a specification estimation model constructed by machine learning using training data with the operation parameter as an input value and the specification parameter as an output value, and the specification parameter acquisition unit may estimate the specification parameter by inputting the operation parameter acquired by the operation parameter acquisition unit into the specification estimation model stored in the specification estimation model storage unit.

According to this configuration, since the specification parameter is estimated by inputting the acquired operation parameter into the specification estimation model constructed by machine learning using training data with the operation parameter as an input value and the specification parameter as an output value, it is not necessary to store in advance the specification parameter of the work machine, and it is possible to automatically specify the specification parameter from the operation parameter.

In the damage estimation device described above, the damage estimation device may further include a specification parameter storage unit that stores in advance the specification parameter of the work machine, in which the specification parameter acquisition unit may acquire, from the specification parameter storage unit, the specification parameter of the work machine to be estimated.

According to this configuration, since the specification parameter of the work machine is stored in advance, it is possible to easily acquire the accurate specification parameter of the work machine to be estimated.

In the damage estimation device described above, the work machine may include a lower travelling body, an upper slewing body mounted on the lower travelling body, and a work device including a boom supported on the upper slewing body in a raising and lowering manner, an arm swingably coupled to a tip end of the boom, and a bucket attached to a tip end of the arm and pressed against a construction surface, and the specification parameter may include a length of the boom, a length of the arm, and a capacity of the bucket.

If the length of the boom, the length of the arm, and the capacity of the bucket are different, the damage caused to a predetermined portion of the work machine is also different, and hence it is possible to estimate a more accurate damage parameter by using a damage estimation model associated with a specification parameter including the length of the boom, the length of the arm, and the capacity of the bucket.

In the damage estimation device described above, the damage estimation device may further include a transmission unit that transmits the damage parameter estimated by the estimation unit to a display device communicatively connected with the damage estimation device.

According to this configuration, since the estimated damage parameter is transmitted to the display device communicatively connected with the damage estimation device, it is possible to present damage in a predetermined portion of the work machine.

In the damage estimation device described above, the damage estimation device may further include a damage parameter storage unit that stores the damage parameter estimated by the estimation unit.

According to this configuration, since the estimated damage parameter is stored, it is possible to accumulate past damage parameters as log information, and it is possible to present the accumulated past damage parameters.

A machine learning device according to another aspect of the present disclosure is a machine learning device that performs machine learning on a damage estimation model for estimating damage in a predetermined portion associated with an operation of a work machine, the machine learning device including: a training data input unit that inputs training data including an operation parameter related to an operation of the work machine and a damage parameter related to damage in the predetermined portion of the work machine, which are obtained when the work machine operates; a damage estimation model storage unit that stores the damage estimation model having the operation parameter as an input value and the damage parameter as an output value; and a learning unit that inputs the operation parameter included in the training data into the damage estimation model and performs machine learning on the damage estimation model so as to minimize an error between a damage parameter output from the damage estimation model and the damage parameter included in the training data.

According to this configuration, since an operation parameter included in the training data is input to a damage estimation model having an operation parameter related to the operation of the work machine as an input value and a damage parameter related to the damage in a predetermined portion of the work machine as an output value, and machine learning is performed on the damage estimation model so as to minimize the error between the damage parameter output from the damage estimation model and the damage parameter included in the training data, it is possible to accurately and easily estimate the lifespan of the work machine from the estimated damage parameter by inputting the acquired operation parameter to a damage estimation model constructed by machine learning using training data.

The specific aspects or examples described in Description of Embodiments merely clarify the technical contents of the present disclosure, and should not be construed narrowly as being limited to such specific examples but can be carried out in various modifications within the scope of the spirit of the present disclosure and the claims.

Since the damage estimation device and the machine learning device according to the present disclosure are capable of accurately and easily estimating the lifespan of a work machine, they are useful as a damage estimation device that estimates damage in a predetermined portion associated with the operation of a work machine, and a machine learning device that performs machine learning on a damage estimation model for estimating damage in a predetermined portion associated with the operation of a work machine.

The invention claimed is:

1. A damage estimation device that estimates damage in a predetermined portion associated with an operation of a work machine, the damage estimation device comprising:

an operation parameter acquisition unit that acquires an operation parameter related to the operation of the work machine;

a damage estimation model storage unit that stores a damage estimation model constructed by machine learning using training data with the operation parameter as an input value and a damage parameter related to damage in the predetermined portion of the work machine as an output value; and an estimation unit that estimates the damage parameter by inputting the operation parameter acquired by the operation parameter acquisition unit to the damage estimation model stored in the damage estimation model storage unit, wherein the damage estimation model includes a plurality of damage estimation models different for each specification of the work machine, the damage estimation model storage unit stores each of a plurality of specification parameters related to a specification of the work machine and each of the plurality of damage estimation models in association with each other, the work machine includes a lower travelling body, an upper slewing body mounted on the lower travelling body, and a work device including a boom supported on the upper slewing body in a raising and lowering manner, an arm swingably coupled to a tip end of the boom, and a tip attachment attached to a tip end of the arm, the specification parameter includes a combination of a length of the boom, a length of the arm, and a specification of the tip attachment, the damage estimation model storage unit stores each of a plurality of combinations of a length of a boom, a length of an arm, and a specification of a tip attachment and each of the plurality of damage estimation models in association with each other, the damage estimation device further comprises:

a specification parameter acquisition unit that acquires a combination of a length of a boom, a length of an arm, and a specification of a tip attachment of a work machine to be estimated; and a selection unit that selects a damage estimation model associated with the the combination of the length of the boom, the length of the arm, and the specification of the tip attachment acquired by the specification parameter acquisition unit from among the plurality of damage estimation models stored in the damage estimation model storage unit, and the estimation unit estimates the damage parameter by inputting the operation parameter acquired by the operation parameter acquisition unit into the damage estimation model selected by the selection unit.

2. The damage estimation device according to claim 1, wherein the work machine further includes a slewing motor that slews the upper slewing body with respect to the lower travelling body, and the operation parameter includes:

a pressure value of each of a boom cylinder, which raises and lowers the boom, an arm cylinder, which swing the arm, and a tip attachment cylinder, which swings the tip attachment;

a length of each of the boom cylinder, the arm cylinder, and the tip attachment cylinder;

an operation pressure value of the slewing motor; and a slewing angle by the slewing motor.

3. The damage estimation device according to claim 1, wherein the damage parameter includes any of strain in the predetermined portion of the work machine, stress generated in the predetermined portion of the work machine, and a lifespan amount of the predetermined portion of the work machine.

4. The damage estimation device according to claim 1, further comprising a specification estimation model storage unit that stores a specification estimation model constructed by machine learning using training data with the operation parameter as an input value and the specification parameter as an output value, wherein the specification parameter acquisition unit estimates the specification parameter by inputting the operation parameter acquired by the operation parameter acquisition unit into the specification estimation model stored in the specification estimation model storage unit.

5. The damage estimation device according to claim 1, further comprising a specification parameter storage unit that stores in advance the specification parameter of the work machine, wherein the specification parameter acquisition unit acquires, from the specification parameter storage unit, the specification parameter of the work machine to be estimated.

6. The damage estimation device according to claim 1, further comprising a transmission unit that transmits the damage parameter estimated by the estimation unit to a display device communicatively connected with the damage estimation device.

7. The damage estimation device according to claim 1, further comprising a damage parameter storage unit that stores the damage parameter estimated by the estimation unit.

8. A machine learning device that performs machine learning on a damage estimation model for estimating damage in a predetermined portion associated with an operation of a work machine, the machine learning device comprising:

a training data input unit that inputs training data including an operation parameter related to an operation of the work machine and a damage parameter related to damage in the predetermined portion of the work machine, which are obtained when the work machine operates;

a damage estimation model storage unit that stores the damage estimation model having the operation parameter as an input value and the damage parameter as an output value; and a learning unit that inputs the operation parameter included in the training data into the damage estimation model and performs machine learning on the damage estimation model so as to minimize an error between a damage parameter output from the damage estimation model and the damage parameter included in the training data, wherein the damage estimation model includes a plurality of damage estimation models different for each specification of the work machine, the damage estimation model storage unit stores each of a plurality of specification parameters related to a specification of the work machine and each of the plurality of damage estimation models in association with each other, the work machine includes a lower travelling body, an upper slewing body mounted on the lower travelling body, and a work device including a boom supported on the upper slewing body in a raising and lowering manner, an arm swingably coupled to a tip end of the boom, and a tip attachment attached to a tip end of the arm, the specification parameter includes a combination of a length of the boom, a length of the arm, and a specification of the tip attachment, the damage estimation model storage unit stores each of a plurality of combinations of a length of a boom, a length of an arm, and a specification of a tip attachment and each of the plurality of damage estimation models in association with each other, the learning unit selects a damage estimation model associated with the combination of the length of the boom, the length of the arm, and the specification of the tip attachment included in the training data input by the training data input unit from among the plurality of damage estimation models stored in the damage estimation model storage unit, and performs machine learning on the selected damage estimation model.

* * * * *